US005270618A

United States Patent [19]

Nilssen

[11] Patent Number: 5,270,618

[45] Date of Patent: Dec. 14, 1993

[54] MAGNETIC-ELECTRONIC DUAL-FREQUENCY BALLAST

[76] Inventor: Ole K. Nilssen, Caesar Dr., Barrington, Ill. 60010

[21] Appl. No.: 524,712

[22] Filed: May 18, 1990

Related U.S. Application Data

[63] Continuation of Ser. No. 1,830, Jan. 9, 1987, abandoned.

[51] Int. Cl.[5] ..... H05B 37/00

[52] U.S. Cl. ..... 315/176; 315/200 R

[58] Field of Search ..... 315/200 R, 176

[56] References Cited

U.S. PATENT DOCUMENTS

| | | | |
|---|---|---|---|
| 4,187,448 | 2/1980 | Kuroi et al. | 315/DIG. 5 |
| 4,362,971 | 12/1982 | Sloan, Jr. | 315/176 |
| 4,388,561 | 6/1983 | Koshimura et al. | 315/DIG. 7 |
| 4,392,086 | 7/1983 | Ide et al. | 315/176 |
| 4,484,107 | 11/1984 | Kaneda | 315/176 |
| 4,604,552 | 8/1986 | Alley et al. | 315/DIG. 4 |
| 4,612,478 | 9/1986 | Payne | 315/DIG. 4 |

*Primary Examiner*—Eugene R. LaRoche
*Assistant Examiner*—Son Dinh

[57] ABSTRACT

A magnetic-electronic fluorescent lamp ballast is so arranged that the fluorescent lamp is powered simultaneously by two different currents; which two currents are supplied to the lamp by two separate parallel-connected current sources. One current is of 60 Hz frequency and is supplied directly from an ordinary 120 Volt/60 Hz power line by way of an ordinary magnetic reactor. The other current is of 30 kHz frequency and is derived from the power line by way of a frequency converter and is then supplied to the fluorescent lamp by way of a 30 kHz resonant circuit and a high-pass filter. The frequency converter is powered from the power line by way of a capacitive reactor, with the net result being that the power factor of the total power drawn from the power line is very high. The overall ballast is simple and provides for a relatively high efficacy.

8 Claims, 2 Drawing Sheets

MAGNETIC-ELECTRONIC DUAL-FREQUENCY BALLAST

This application is a continuation of Ser. No. 001,830, filed Jan. 9, 1987, abandoned.

BACKGROUND OF THE INVENTION

1. Field of the Invention

The present invention relates to ballasts for fluorescent lamps, particularly of a kind wherein each lamp is powered by two separate current sources of different frequencies.

2. Elements of Prior Art

A power-line-operated electronic fluorescent lamp ballast typically consists of a power-factor-correcting input circuit and a frequency-converting power supply operable to supply the fluorescent lamp with a current of frequency substantially higher than that of the power line voltage, thereby attaining higher-than-normal lamp luminous efficacy.

One of the reasons for attaining this higher-than-normal lamp luminous efficacy is that of maintaining the ionization of the gas inside the fluorescent lamp at a substantially constant level; which indeed results when suppling the lamp with a high-frequency sinusoidally alternating current.

In contrast, when supplying the lamp with 60 Hz sinusoidally alternating current, the lamp's ionization level will vary approximately in proportion to the instantaneous magnitude of the lamp current; an effect which does not occur when the lamp is being powered with a current of frequency so high that the response-time of ionization is low in comparison with the duration of a half cycle of the high-frequency current.

However, the power-factor-correcting input circuit is apt to dissipate as much power as is saved by maintaining the lamp's ionization level constant; which therefore reduces the improvement in luminous efficacy otherwise attainable.

SUMMARY OF THE INVENTION

Objects of the Invention

An object of the present invention is that of providing for a cost-effective means by which to power fluorescent lamps in such manner as to attain a relatively high luminous efficacy.

Another object is that of providing a means for powering a gas discharge lamp with two separate currents, the one current being of frequency substantially higher than that of the other.

These as well as other objects, features and advantages of the present invention will become apparent from the following description and claims.

BRIEF DESCRIPTION

A fluorescent lamp is powered simultaneously by two different currents; which two currents are supplied to the lamp by two separate parallel-connected current sources. One current is: i) a substantially sinusoidal current of 60 Hz frequency, and ii), supplied directly from the 120 volt/60 Hz power line by way of an ordinary magnetic-inductive reactor. The other current is: i) a substantially sinusoidal current of 30 kHz frequency and amplitude-modulated at 60 Hz, ii) derived from the power line by way of a frequency converter, and iii) supplied to the fluorescent lamp by way of a resonant L-C circuit and a high-pass filter. The RMS magnitudes of the two different currents are approximately equal; which means that the RMS magnitude of the resultant current, which is the quadratic sum of the RMS magnitudes of the two different currents, is about 40% larger than the RMS magnitude of one of the currents.

The frequency converter is powered from the power line by way of a current-limiting series-connected capacitive reactor.

The amplitude-modulated 30 kHz squarewave output voltage from the frequency converter is applied to a series-resonant L-C circuit; and the fluorescent lamp is connected in parallel-circuit with the tank-capacitor of this L-C circuit by way of a high-frequency coupling capacitor.

As an overall result, the RMS magnitude of the resultant lamp current will remain substantially constant throughout each complete cycle of the 60 Hz power line voltage; which implies that the ionization of the lamp's gas wall remain substantially constant, thereby providing for improved lamp luminous efficacy.

The current drawn from the power line through the magnetic-inductive reactor is lagging by about 45 degrees; and the current drawn from the power line through the capacitive reactor is leading by about 45%. As an overall result, the net total current drawn from the power line is nearly sinusoidal in waveshape and substantially in phase with the power line voltage.

Lamp cathode heating is provided in a trigger-start manner by way of secondary windings on the tank-inductor of the series-resonant L-C circuit.

DESCRIPTION OF THE PREFERRED EMBODIMENT

Details of Construction

Figure 1:
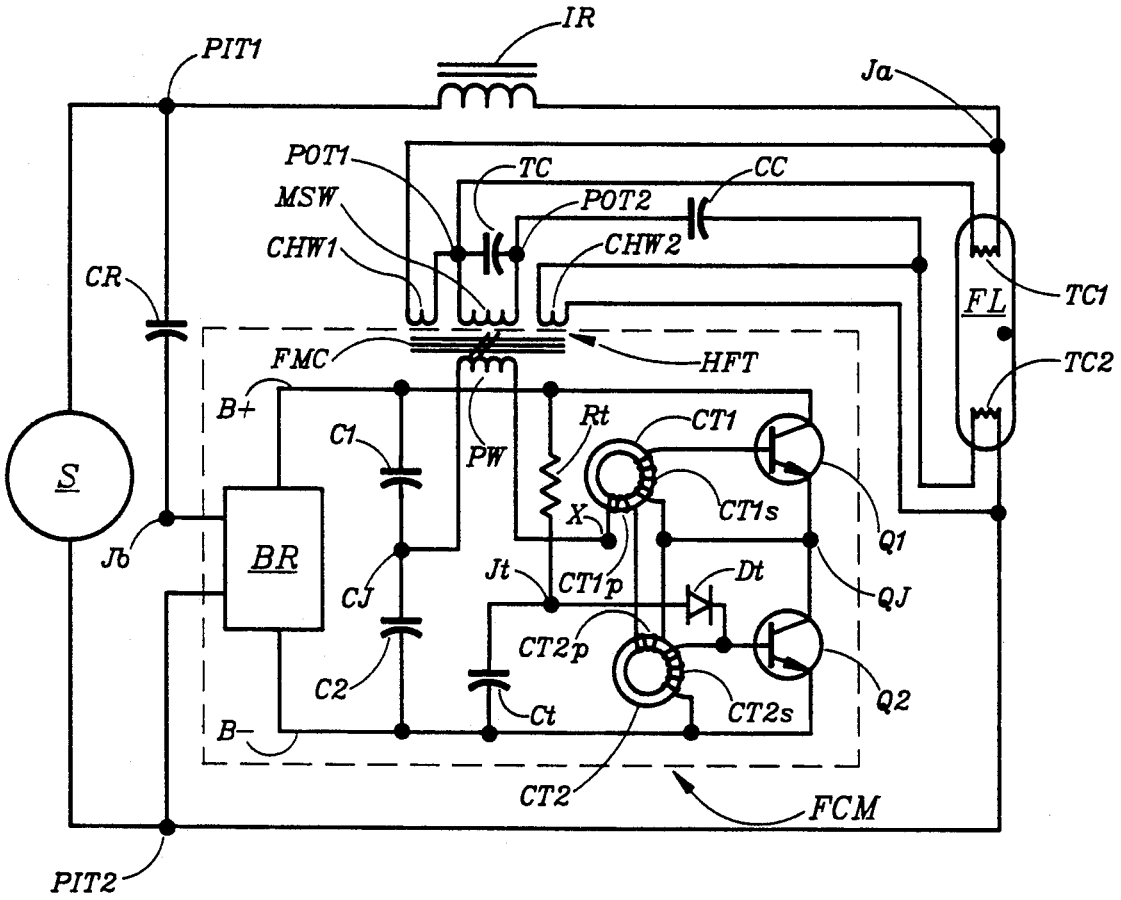
FIG. 1 schematically illustrates the preferred embodiment of the invention.

In FIG. 1, a source S of 120 Volt/60 Hz voltage is applied across ballast power input terminals PIT1 and PIT2. An inductive reactor IR is connected between power input terminal PIT1 and a junction Ja; and a capacitive reactor CR is connected between power input terminal PIT1 and a junction Jb.

A fluorescent lamp FL has: i) a first thermionic cathode TC1 connected with one of its two terminals to junction Ja, and ii) a second thermionic cathode TC2 connected with one of its two terminals to power input terminal PIT2.

A full-wave bridge rectifier BR is connected between junction Jb and power input terminal PIT2. The unidirectional voltage output of bridge rectifier BR is applied directly between a B+ bus and a B− bus, with the positive voltage being connected to the B+ bus.

Between the B+ bus and the B− bus are connected a series-combination of two transistors Q1 and Q2 as well as a series-combination of two film-type capacitors C1 and C2.

The collector of transistor Q1 is connected directly with the B+ bus; the emitter of transistor Q2 is connected directly with the B− bus; and the emitter of transistor Q1 is connected directly with the collector of transistor Q2, thereby forming junction QJ.

One terminal of capacitor C1 is connected directly with the B+ bus, while the other terminal of capacitor C1 is connected with a junction CJ. One terminal of capacitor C2 is connected directly with the B− bus, while the other terminal of capacitor C2 is connected directly with junction CJ.

The secondary winding CT1s of a first positive feedback current transformer CT1 is connected between the base and the emitter of transistor Q1; and the secondary winding CT2s of a second positive feedback current transformer CT2 is connected between the base and the emitter of transistor Q2.

The primary winding PW of a high-frequency transformer HFT is connected between junction CJ and a point X; and primary windings CT1p and CT2p of transformers CT1 and CT2 are connected in series between point X and junction QJ.

A resistor Rt is connected between the B+ bus and a junction Jt; a capacitor Ct is connected between junction Jt and the Bbus; and a Diac Dt is connected between junction Jt and the base of transistor Q2.

High-frequency transformer HFT has: i) a ferrite magnetic core FMC, ii) a main secondary winding MSW with power output terminals POT1 and POT2, across which is connected a tank-capacitor TC, iii) a first cathode heater winding CHW1 connected directly with the terminals of first thermionic cathode TC1, and iv) a second cathode heater winding CHW2 connected directly with the terminals of second thermionic cathode TC2. Power output terminal POT1 is connected with one of the terminals of thermionic cathode TC1; and power output terminal POT2 is connected with one of the terminals of thermionic cathode TC2 by way of a coupling capacitor CC.

The complete assembly comprised between: i) the pair of terminals identified as Jb and PIT2, and ii) the secondary windings of high-frequency transformer HFT, is referred-to as frequency converter means FCM.

Details of Operation

Figure 2:
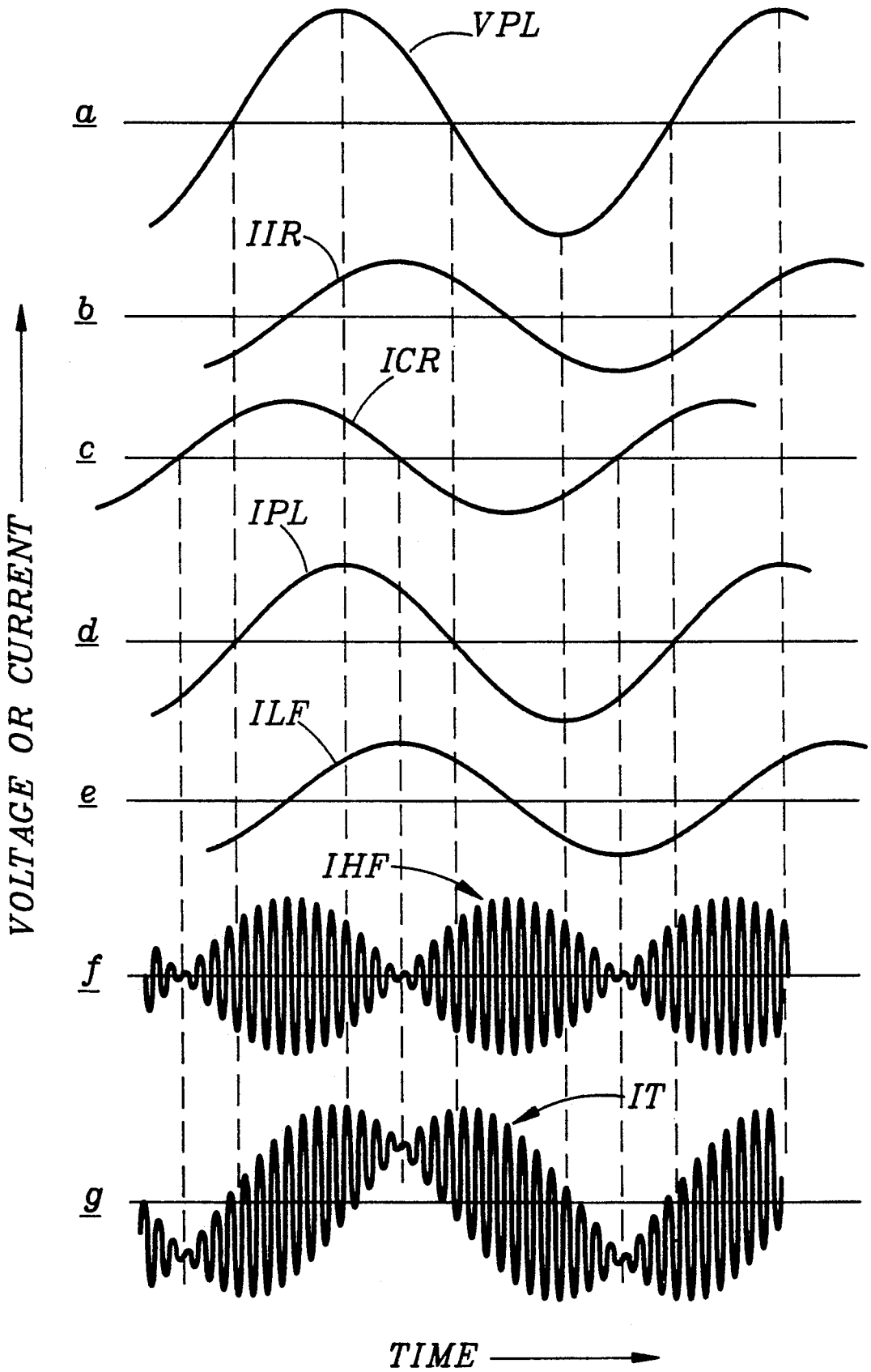
FIG. 2 illustrates typical voltage and current waveforms associated with the preferred embodiment of FIG. 1

The operation of the ballast arrangement of FIG. 1 may best be understood when reading the following explanation in light of the waveforms illustrated by FIG. 2.

In FIG. 2*a*, the waveform identified as VPL represents the voltage provided by the power line voltage source S of FIG. 1.

In FIG. 2*b*, the waveform identified as IIR represents the current drawn from the power line through inductive reactor IR.

In FIG. 2*c*, the waveform identified as ICR represents the current drawn from the power line by the frequency converter through capacitive reactor CR.

In FIG. 2*d*, the waveform identified as IPL represents the net current drawn from the power line by the complete ballast arrangement of FIG. 1.

In FIG. 2*e*, the waveform identified as ILF represents the low-frequency or 60 Hz component of the current flowing through fluorescent lamp FL. This waveform is identical with that of FIG. 2*b*.

In FIG. 2*f*, the waveform identified as IHF represents the high-frequency or 30 kHz component of the current flowing through fluorescent lamp FL.

In FIG. 2*g*, the waveform identified as IT represents the total net current flowing through fluorescent lamp FL.

The overall operation of the dual-frequency ballasting arrangement of FIG. 1 involves feeding to the fluorescent lamp two distinctly separate components of current: one component from each of two distinctly separate and substantially noncoupled current sources.

One of the current-components is provided directly from the 120 Volt/60 Hz power line by way of inductive reactor IR. The waveform of this particular current-component is approximately as illustrated by FIG. 2*e*. It is: i) of 60 Hz frequency, ii) nearly sinusoidal in waveshape, and iii) delayed by approximately 45 degrees with respect to the power line voltage of FIG. 2*a*.

The other current-component is provided from the output of frequency converter means FCM; which frequency converter means receives its power input from the 120 Volt/60 Hz power line. The waveform of this particular current-component is approximately as illustrated by FIG. 2*f*. It is: i) of 30 kHz fundamental frequency, ii) amplitude-modulated in the sense of having a peak-to-peak magnitude that is substantially proportional to the instantaneous magnitude of the full-wave-rectified 60 Hz voltage existing between the B+ bus and the B− bus, which is to say: substantially proportional to the instantaneous absolute magnitude of the AC voltage present between junction Jb and terminal PIT2.

The 60 Hz current-component is prevented from shunting into main secondary winding MSW of high-frequency transformer HFT by way of coupling capacitor CC; which coupling capacitor represents an exceedingly high-magnitude inductive reactance to the 60 Hz current-component.

The amplitude-modulated 30 kHz current-component is prevented from shunting into the power line by way of inductive reactor IR; which inductive reactor represents an exceedingly high-magnitude capacitive reactance to the 30 kHz current-component.

In other words, as coming from their respective sources, the two current-components have essentially no other path to take except through fluorescent lamp FL.

Also, the two current-components are each provided from a high-impedance current-limiting voltage source; which is to say that they are each effectively provided from the nearequivalent of a current source. The magnitude of the 60 Hz current-component is manifestly limited by the inductive reactance of inductive reactor IR; and the magnitude of the 30 kHz current-component is manifestly limited by way of the output circuit of frequency converter means FCM.

This output circuit is in effect a resonant L-C circuit that is series-excited by the voltage provided to the primary winding (PW) of high-frequency transformer HFT and parallel-loaded by the fluorescent lamp.

The "L" or tank-inductor of the resonant L-C circuit is provided by the internal inductance of main secondary winding MSW; which main secondary winding is relatively loosely coupled to primary winding PW of high-frequency transformer HFT.

Additional Explanations and Comments a) The operation of frequency converter means FCM may be briefly described as follows.

In FIG. 1, source S represents an ordinary electric utility power line, the voltage from which is applied to bridge rectifier BR by way of current-limiting capacitive reactor CR. This bridge rectifier is of conventional construction and provides for the full-wave-rectified line voltage to be applied to the inverter circuit by way of the B− bus and the B+ bus.

The half-bridge self-oscillating inverter circuit of FIG. 1, which principally consists of elements C1/C2, Q1/Q2, CT1/CT2, and HFT, operates in a manner that is completely analogous with circuits previously described in published literature, as for instance in U.S. Pat. No. Re. 31,758 entitled High Efficiency Push-Pull Inverters.

The inverter must be triggered into self-oscillation; and the requisite triggering is accomplished by a trigger circuit consisting of elements Rt, Ct, and Dt. This trigger circuit provides for the inverter to be triggered into oscillation at the beginning of each half-cycle of the 60 Hz AC voltage applied to the input of bridge rectifier BR.

Capacitors C1 and C2 are so sized that, in comparison to the energy being used by the inverter over a period comparable to the cycle-period of the power line voltage, they store only a negligible amount of energy. In addition to providing for the equivalent of a center-tapped DC voltage supply for the inverter, the principal purpose of capacitors C1 and C2 is that of providing for a low-impedance path for currents of 30 kHz.

Thus, capacitors C1/C2 will not have any significant impact on the gross waveshape of the DC voltage between the B+ bus and the B− bus; which waveshape is the full-wave-rectified equivalent of the waveshape of the AC voltage provided to the input of bridge rectifier BR.

The output of the half-bridge inverter is a substantially squarewave 30 kHz AC voltage; which output is provided between point X and junction CJ. Of course, for purposes of the 30 kHz squarewave voltage, junction CJ is at the same voltage level as the B− bus and/or the B+ bus.

Across the inverter's output, by way of high-frequency transformer HFT, is effectively connected a resonant or near-resonant L-C series circuit, with the fluorescent lamp being connected in parallel with the tank-capacitor (TC) thereof.

At the 30 kHz frequency, the output from the half-bridge inverter may be considered as effectively constituting a voltage source since, at this relatively high frequency, it exhibits substantially negligle internal source impedance.

Thus, in effect, the 30 kHz inverter voltage source is operative to series-excite the resonant L-C circuit; which L-C circuit is parallel-loaded by the fluorescent lamp.

One important feature of such a series-excited parallel-loaded L-C resonant method of lamp ballasting relates to the fact that—as long as the series-exciting source is a near perfect voltage source—it appears to the parallel-connected load as a near perfect current source, with the magnitude of the current supplied to the parallel-connected load being proportional to the magnitude of the voltage used for seriesexcitation.

In the inverter, transistors Q1 and Q2 are in effect switches that are turned ON and OFF in obverse synchrony at a 30 kHz rate. Thus, junction QJ—which, but for a minute voltage drop across the primary windings of current transformers CT1 and CT2, is electrically the same as point X—is alternately connected with the B+ bus and the B− bus.

The loading on the inverter's output caused by the series- excited parallel-loaded main load circuit, which consists of the resonant L-C series-combination and fluorescent lamp FL, is substantially resistive at the fundamental frequency of the 30 kHz inverter squarewave voltage output. Thus, the load current flowing from point X into inductor L is nearly sinusoidal in waveshape and nearly in phase with the fundamental sinusoidal frequency component of the squarewave.

Hence, the loading of the inverter by the main load circuit is accomplished by way of a relatively high power factor; which provides for exceptionally efficient loading of the inverter.

An important point to recognize is that the instantaneous peak magnitude of the 30 kHz squarewave inverter output voltage (i.e., the voltage provided between junction CJ and point X) is always equal to half the instantaneous magnitude of the DC voltage applied to the inverter (i.e., the voltage existing between the B+ bus and the B− bus).

b) Before the fluorescent lamp ignites, or if the fluorescent lamp is disconnected, the maximum magnitude of the 30 kHz voltage developing across tank-capacitor TC of the high-Q resonant L-C circuit is limited by the current-limiting feature of capacitive reactance CR.

In the preferred embodiment, this maximum magnitude is arranged to be such as to constitute a suitable starting voltage for the fluorescent lamp.

c) In one sense, the ballasting arrangement of FIG. 1 may be viewed as an electronic ballast of somewhat unconventional design—consisting of everything in FIG. 1, except inductive reactor IR—wherein a magnetic reactor means (i.e., inductive reactor IR) is used for power factor correction as well as to power the fluorescent lamp during the periods where the magnitude of the high-frequency current gets to be so small as to nearly extinguish the ionization of the plasma within the lamp.

d) By making the magnitude of the current flowing through inductive reactor about equal to that of the current flowing through the capacitive reactor, a situation is established where: i) the power factor associated with the power drawn by the ballast from the power line is nearly 100%, and ii) the power provided to the lamp by the 60 Hz current-component is about equal to that provided by the 30 kHz current-component.

As an overall result, the plasma within the lamp will be provided with a substantially constant level of power; which implies that its ionization level will remain approximately constant; which is to say: practically without any modulation at the 120 Hz "power frequency" of the 60 Hz power line voltage.

e) When two currents of equal RMS magnitudes but of different frequencies are added together, as indeed they are in fluorescent lamp FL, and when the power components of these two currents (as represented by the squares of the currents) are 90 degrees apart in phase, resultant RMS magnitude becomes constant when viewed from a time-scale that is relatively long as compared with the duration of one full power period (i.e., the duration of a complete half-cycle) of the 30 kHz current.

Since the natural time-constant of decay of inonization of the lamp's plasma is indeed relatively long as compared with the duration of a half-cycle of the 30 kHz current, the lamp's plasma does indeed remain at a substantially constant level of ionization.

As long as the lamp's ionization remains constant, the lamp will constitute an essentially constant-resistance load.

f) The lamp's thermionic cathodes are heated by windings coupled tightly with the main secondary winding (MSW). As a result, before the lamp ignites, the magnitude of the voltage provided to the cathodes is substantially larger than that of the voltage provided to the cathodes after the lamp has ignited.

Since, for most Pre-Heat and Rapid-Start lamps, it is not necessary to provide external cathode heating after the lamp has ignited, significant energy savings result.

g) It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. An arrangement comprising:

source terminals operable to connect with the power line voltage of an ordinary electric utility power line;

lamp means having lamp terminals, the lamp means being operative to provide a light output in response to current flowing therethrough;

first means: i) connected in circuit between the source terminals and the lamp terminals, and ii) operative, whenever the source terminals are indeed connected with the power line, to cause a first current to flow through the lamp means; and second means: i) connected in circuit between the source terminals and the lamp terminals, ii) operative, whenever the source terminals are indeed connected with the power line, to cause a second current to flow through the lamp means, and iii) having frequency conversion means;

whereby: i) the frequency of the second current is substantially higher than the frequency of the first current, ii) the second current is amplitude-modulated at twice the frequency of the first current, and iii) the absolute magnitude of the second current is at its maximum approximately at the time when the absolute magnitude of the first current is at its minimum.

2. The arrangement of claim 1 wherein the lamp means comprises a gas discharge lamp.

3. The arrangement of claim 1 wherein the fundamental frequency of the first current is equal to that of the power line voltage.

4. The arrangement of claim 1 wherein the first means comprises inductive reactance means operative to limit the magnitude of the first current.

5. The arrangement of claim 4 wherein the second means comprises capacitive reactance means operative to limit the magnitude of the second current.

6. The arrangement of claim 1 combined with power factor correction means operative, whenever the source terminals are indeed connected with the power line, to cause the current drawn by the source terminals from the power line to exhibit a power factor of at least 90%.

7. An arrangement comprising:

source terminals connected with the relatively low-frequency power line voltage of an ordinary power line;

first low-frequency reactance means connected in circuit between the source terminals and a pair of intermediary terminals; thereby to cause a first relatively low-frequency current to be provided to these intermediary terminals;

frequency-conversion means connected with the intermediary terminals and operative to convert the first relatively low-frequency current provided thereto into a relatively high-frequency current provided to a pair of output terminals; the high-frequency current being amplitude-modulated such that its absolute magnitude is at its maximum at times whenever the absolute magnitude of the low-frequency current is at its minimum;

lamp means connected with the output terminals and being operative to be powered by the relatively high-frequency current provided thereto, the magnitude of the high-frequency current being manifestly determined at least in part by the first low-frequency reactance means.

8. The arrangement of claim 7 combined with a second low-frequency reactance means connected in circuit with the source terminals and operative to draw a second low-frequency current therefrom, the phase of this second low-frequency current being different from that of the first low-frequency current;

such that the combined low-frequency current drawn from the source terminals is substantially in phase with the power line voltage.

* * * * *